US008861993B2

(12) United States Patent
Tsugawa et al.

(10) Patent No.: US 8,861,993 B2
(45) Date of Patent: Oct. 14, 2014

(54) IMAGE FORMING APPARATUS, STORAGE UNIT CONTROLLING METHOD, AND STORAGE UNIT CONTROLLING PROGRAM PRODUCT

(75) Inventors: Masaki Tsugawa, Kanagawa (JP); Masatoshi Inoue, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 285 days.

(21) Appl. No.: 13/411,894

(22) Filed: Mar. 5, 2012

(65) Prior Publication Data

US 2012/0237238 A1 Sep. 20, 2012

(30) Foreign Application Priority Data

Mar. 18, 2011 (JP) ..... 2011-060968

(51) Int. Cl.
*G03G 15/00* (2006.01)
*G03G 15/08* (2006.01)

(52) U.S. Cl.
CPC ..... *G03G 15/0856* (2013.01); *G03G 15/556* (2013.01)
USPC ..... 399/27; 399/12; 399/61

(58) Field of Classification Search
CPC ..... G03G 15/553; G03G 15/556; G03G 21/1878; G03G 21/1882; G03G 21/1889; G03G 2215/0695; G03G 2215/0697
USPC ..... 399/12, 27
See application file for complete search history.

(56) References Cited

U.S. PATENT DOCUMENTS 5,923,917 A * 7/1999 Sakurai et al. ..... 399/27

FOREIGN PATENT DOCUMENTS

JP 2007-248538 A 9/2007

* cited by examiner

*Primary Examiner* — David Gray
*Assistant Examiner* — Michael Harrison
(74) *Attorney, Agent, or Firm* — Harness, Dickey & Pierce, P.L.C.

(57) ABSTRACT

An image forming apparatus includes a control unit that controls each component, a first storage unit that is a non-volatile and rewritable storage unit mounted on the control unit, a toner containing unit that contains toner to be used for an image forming, a second storage unit that is a non-volatile and rewritable storage unit mounted on the toner containing unit, and a detecting unit that detects an amount of the toner remained in the toner containing unit. The control unit stores count information into the second storage unit, the count information is copied from the second storage unit to the first storage unit, when the detecting unit detects that the amount of the toner remained in the toner containing unit is not enough, and the count information is kept on being stored into the first storage unit, until the toner containing unit is replaced with a new one.

11 Claims, 6 Drawing Sheets

IMAGE FORMING APPARATUS, STORAGE UNIT CONTROLLING METHOD, AND STORAGE UNIT CONTROLLING PROGRAM PRODUCT

CROSS-REFERENCE TO RELATED APPLICATIONS

The present application claims priority to and incorporates by reference the entire contents of Japanese Patent Application No. 2011-060968 filed in Japan on Mar. 18, 2011.

BACKGROUND OF THE INVENTION

1. Field of the Invention

The present invention relates to an image forming apparatus, a storage unit controlling method, and a storage unit controlling program product.

2. Description of the Related Art

In an image forming apparatus such as a digital MFP (Multi Function Peripheral) and the like, there is provided an EEPROM (Electrically Erasable Programmable Read-Only Memory) to store count information representing a printing quantity and/or various setting values on a control board. The EEPROM is a non-volatile rewritable memory and has a rewriting limit (lifetime) in its number of times. The rewriting lifetime is approximately a hundred thousand times. On the other hand, the upper limit of the printing quantity in the MFP is approximately a million and half shetts. Thus, if the printing quantity such as monochrome printing quantity or color printing quantity is counted by the EEPROM which is mounted on the control board of the MFP main body, the upper limit of the printing quantity in the MFP exceeds the rewriting lifetime of the EEPROM.

In order to address the aforementioned problem, there is provided a method of averaging and thereby limiting the rewriting in its number of times for each address, resulting in the improved lifetime of the EEPROM device. However, this method of limiting the number of times still has the problems that (i) the lifetime of the EEPROM mounted on the control board of the MFP main body becomes shorter, since the printing quantity is counted only by the EEPROM of the control board of the MFP main body and the rewriting increases in its frequency, (ii) a large capacity EEPROM is required in order to reduce the rewriting rotation frequency, (iii) the replacement of the control board is required when recycling the MFP main body, since the lifetime of the EEPROM ends when recycling the control board [sic], and (iv) the averaging effect cannot be obtained in a case that the rewriting number of times is the same for all the addresses.

The invention disclosed in Japanese Patent Application Laid-open No. 2007-248538 is known as a technology to cope with these problems. In this invention, an EEPROM attached to a toner bottle is used. Namely, apart from an EEPROM mounted on a control board of an MFP main body, each toner bottle is provided with an EEPROM; the EEPROM mounted on the control board records thereon the counted number of copies made in the MFP main body, and the EEPROM attached to each toner bottle records thereon the counted number of copies made by use of toner in the toner bottle. To extend the life of the EEPROM attached to each color toner bottle, not at the end of job but at the time of replacement of the toner bottle, data on the number of copies recorded on the EEPROM mounted on the control board is written on the EEPROM attached to the toner bottle. This reduces the number of times the EEPROM attached to the toner bottle is rewritten, thereby extending the life of the EEPROM.

However, the invention disclosed in Japanese Patent Application Laid-open No. 2007-248538 can extend the life of the EEPROM attached to the toner bottle, but the above-described problems (i) and (iii) are not resolved, that is, the life of the EEPROM mounted on the control board of the MFP main body is still short, so a large-capacity EEPROM needs to be mounted or the EEPROM needs to be replaced at the time of recycling of the MFP main body.

SUMMARY OF THE INVENTION

It is an object of the present invention to at least partially solve the problems in the conventional technology.

An image forming apparatus provided with a control unit that controls each component, a first storage unit that is a non-volatile and rewritable storage unit mounted on the control unit, a toner containing unit that contains toner to be used for an image forming, a second storage unit that is a non-volatile and rewritable storage unit mounted on the toner containing unit, and a detecting unit that detects an amount of the toner remained in the toner containing unit. The control unit stores count information into the second storage unit, the count information counted at the image forming, the count information is copied from the second storage unit to the first storage unit, when the detecting unit detects that the amount of the toner remained in the toner containing unit is not enough, and the count information is kept on being stored into the first storage unit, until the toner containing unit is replaced with a new one.

A method of controlling a storage unit for an image forming apparatus including a control unit that controls each component, a first storage unit that is a non-volatile and rewritable storage unit mounted on the control unit, a toner containing unit that contains toner to be used for an image forming, a second storage unit that is a non-volatile and rewritable storage unit mounted on the toner containing unit, and a detecting unit that detects an amount of the toner remained in the toner containing unit. The method includes storing count information into the second storage unit, the count information counted at the image forming, copying the count information from the second storage unit to the first storage unit, when the detecting unit detects that the amount of the toner remained in the toner containing unit is not enough, and keeping on storing the count information into the first storage unit, until the toner containing unit is replaced with a new one.

A computer program product comprising a non-transitory computer-readable medium having computer-readable program codes embedded therein for controlling a storage unit by a computer for an image forming apparatus including a control unit that controls each component, a first storage unit that is a non-volatile and rewritable storage unit mounted on the control unit, a toner containing unit that contains toner to be used for an image forming, a second storage unit that is a non-volatile and rewritable storage unit mounted on the toner containing unit, and a detecting unit that detects an amount of the toner remained in the toner containing unit. The program codes, when executed, causes the computer to execute storing count information into the second storage unit, the count information counted at the image forming, copying the count information from the second storage unit to the first storage unit, when the detecting unit detects that the amount of the toner remained in the toner containing unit is not enough, and keeping on storing the count information into the first storage unit, until the toner containing unit is replaced with a new one.

The above and other objects, features, advantages and technical and industrial significance of this invention will be better understood by reading the following detailed description of presently preferred embodiments of the invention, when considered in connection with the accompanying drawings.

Incidentally, the control unit corresponds to a main body control board 10 including a CPU 6 in an embodiment described below; the first storage unit corresponds to a main body EEPROM 1; the toner container or containing unit corresponds to toner bottles K11, M12, C13, and Y14; the second storage unit corresponds to EEPROMs 2(K), 3(M), 4(C), and 5(Y); the detecting unit corresponds to a toner end sensor 17; the cover detecting unit corresponds to a cover open/close detecting sensor 15, the power detecting unit corresponds to a power monitor IC 16; the image forming apparatus corresponds to MFPs 100 and 200.

DETAILED DESCRIPTION OF THE PREFERRED EMBODIMENTS

In an aspect of the invention, the counter information such as the monochrome printing quantity or the color printing quantity is controlled by the EEPROM attached to the toner container (toner containing unit) in advance, not by the EEPROM mounted on the control board of the MFP main body. When it is detected that the replacement of the toner container is coming shortly, the counter information is copied to the EEPROM of the control board of the MFP main body. After the toner container is replaced with a new one, the counter information stored or written in the EEPROM of the control board of the MFP main body is returned to the EEPROM of the toner container. Until it is detected that the next replacement is coming shortly, the monochrome printing quantity or the color printing quantity is counted by the EEPROM of the toner container.

Furthermore, in an aspect of the invention, the counter information such as the monochrome printing quantity or the color printing quantity is distributed as LSB (Least Significant Bit) data (also called "LSB information" or "LSB side information of the counter information") and controlled by the EEPROM attached to the toner container. Thereby, the rewriting number of times is reduced in the MFP main body EEPROM. Namely, the data distribution is performed based on the LSB and MSB (Most Significant Bit). Thus, the data that requires more frequently rewriting is efficiently distributed to the EEPROM attached to the replaceable or consumable component, resulting in the improved lifetime of the EEPROM mounted on the main body. Also in this case, when it is detected that the replacement of the toner container is coming shortly, the counter information is stored or written in the EEPROM mounted on the control board of the MFP main body. After the toner container is replaced with a new one, the counter information stored or written in the EEPROM mounted on the control board of the MFP main body is returned to the EEPROM attached to the toner container. This configuration makes it possible to avoid the data loss in the replacement of the toner container.

Now, embodiments of the present invention will be explained with reference to the accompanying drawings.

Figure 1:
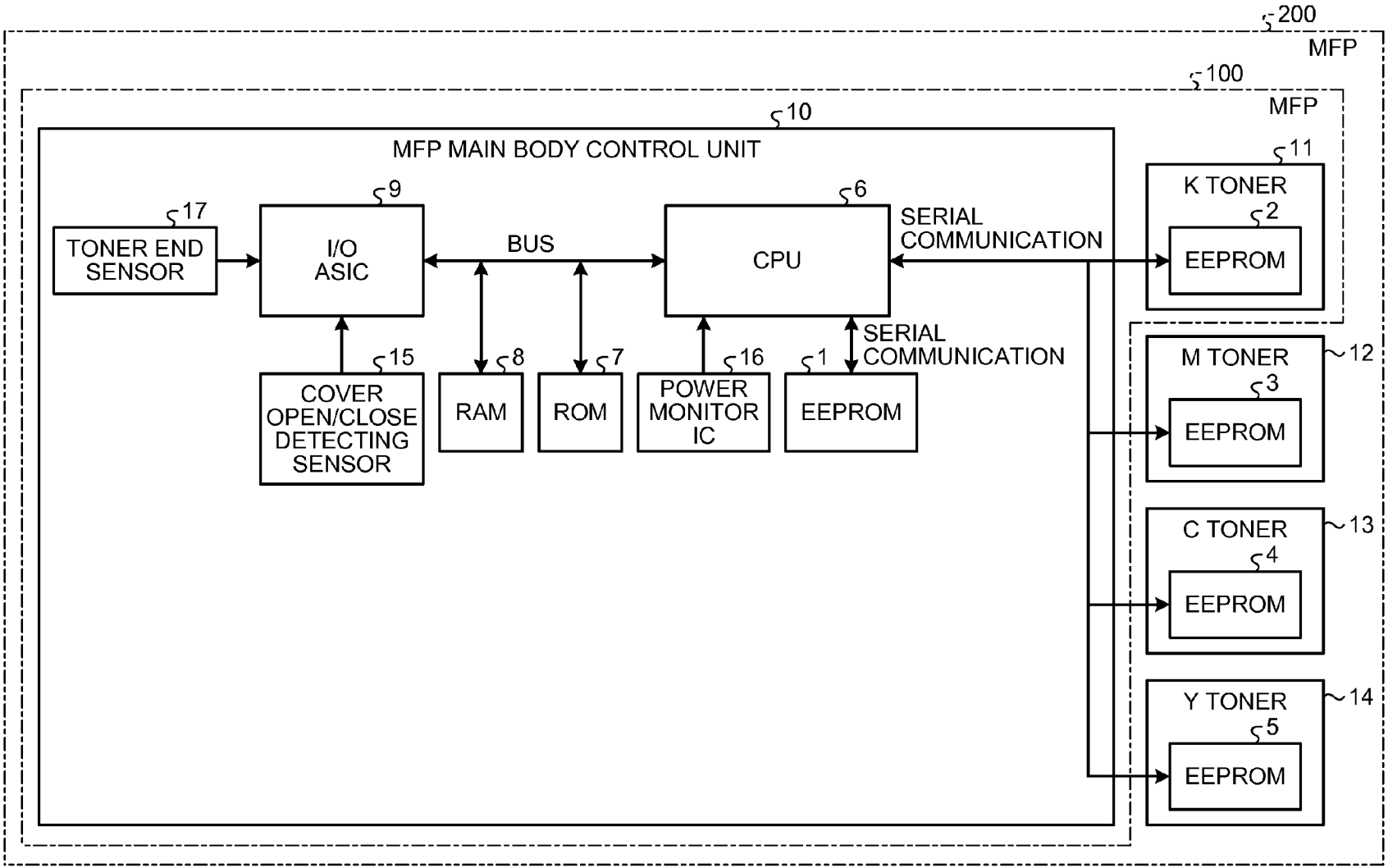
FIG. 1 is a block diagram showing main parts of the control structure of an image forming apparatus according to an embodiment of the present invention.

FIG. 1 is a block diagram schematically showing important parts of an MFP configuration as an image forming apparatus according to an embodiment. The MFP 200 according to the present embodiment is provided with an MFP main body control unit 10, and toner bottles (toner container or toner containing unit) K11, M12, C13 and Y14 for four colors each. In the embodiment, K represents black, M represents magenta, C represents cyan, and Y represents yellow, respectively.

The MFP main body control unit 10 includes a CPU 6, an I/O ASIC 9 for controlling an I/O of motors and sensors, a ROM 7 storing therein a program, a RAM 8 for storing temporarily data, a power monitor IC 16 for detecting a power ON/OFF, a cover sensor 15 for detecting a cover OPEN/CLOSE, an EEPROM 1 (hereinafter called "main body EEPROM") for storing the data even if the power is OFF, and a toner end sensor 17 for detecting a toner remaining amount. The CPU 6 controls each component of the MFP and each component of the main body control unit 10. The CPU 6, the I/O ASIC 9, the ROM 7 and the RAM 8 are connected via bus to communicate with each other. The CPU 6 loads the program stored in the ROM 7 to the RAM 8 and controls aforementioned each component with using the RAM 8 as a working area or data buffer. The toner bottles K11, M12, C13 and Y14 are provided with EEPROMs 2(K), 3(M), 4(C) and 5(Y), respectively (hereinafter these EEPROM(s) may be called "toner EEPROM(s)"), to count the printing quantity that is a number of printed sheets obtained by using the toner contained in these bottles. The EEPROMs 1 to 5 communicate with the CPU 6 via serial communication.

Incidentally, a block surrounded by a dashed-dotted line in FIG. 1 represents a monochrome MFP 100 that forms a monochrome image only by using K toner. A block surrounded by a dashed-two dotted line in FIG. 1 represents a color MFP 200 that forms a full color image by using KMCY four color toners.

Figure 2:
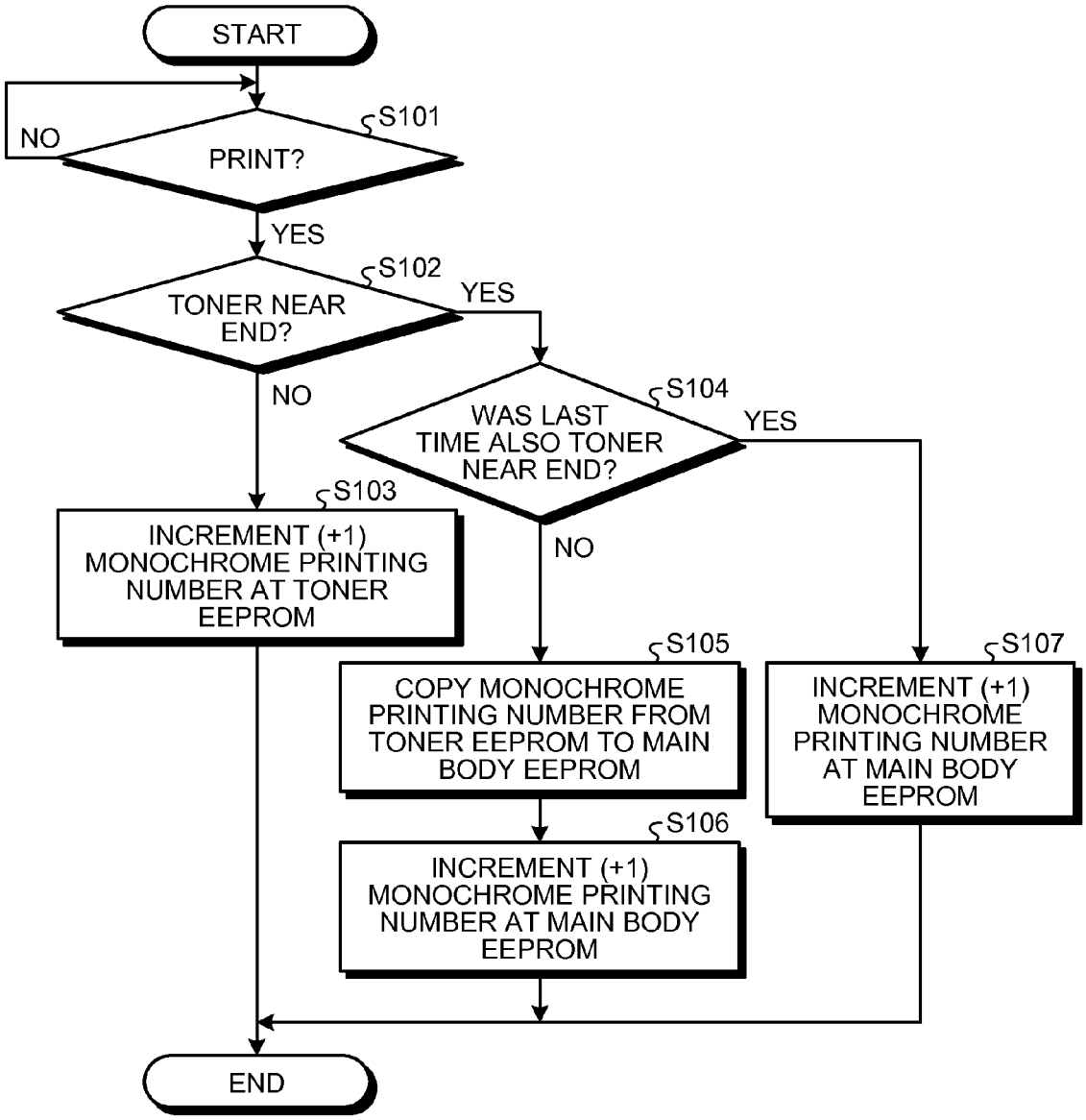
FIG. 2 is a flowchart showing a procedure of a copy-number recording process at the time of printing by the image forming apparatus according to the embodiment.

FIG. 2 is a flow chart showing a procedure of recording the printing quantity when the printing is performed in the MFP (the monochrome MFP 100 in this example) according to the embodiment. In the case of recording the printing quantity for this MFP 100, the number of printing sheets (i.e. the printing quantity) is counted by the toner EEPROM 2(K) during the printing, if it is not detected that the replacement of the toner bottle is coming shortly (i.e. a so-called "toner near end" is not detected). If it is detected that the replacement of the toner bottle is coming shortly, the count information including the number of printing sheets is copied to the main body EEPROM 1 mounted on the control board 10 of the MFP main body, and the number of printing sheets is counted by the main body EEPROM 1. Specifically, if this process is started, it is determined whether the printing operation is required (step S101). If YES at the step S101, the information is read from the toner end sensor 17 during the printing operation, and it is determined whether the replacement of the toner bottle is coming shortly, namely, it is determined whether the status is the tone near end (step S102).

If NO at the step S102, the number of printing sheets is incremented by one at the toner EEPROM 2(K), since the replacement of the toner bottle is not required (step S103).

If YES at the step S12, it is determined whether the status is also the toner near end in the previous judgment (step S104). If NO at the step S104, the information including the number of printing sheets is copied from the toner EEPROM 2(K) to the main body EEPROM 1 mounted on the control board 10 of the MFP main body for the replacement of the toner bottle, since the status becomes the toner near end for the first time (step S105). The number of monochrome printing sheets, which is printed in this time, is incremented by one at the main body EEPROM 1 (step S106).

If YES at the step S104, the number of printing sheets is incremented by one at the main body EEPROM 1, since the number of printing sheets is already counted by the main body EEPROM 1 from the previous "toner near end" judgment (step S107).

Figure 3:
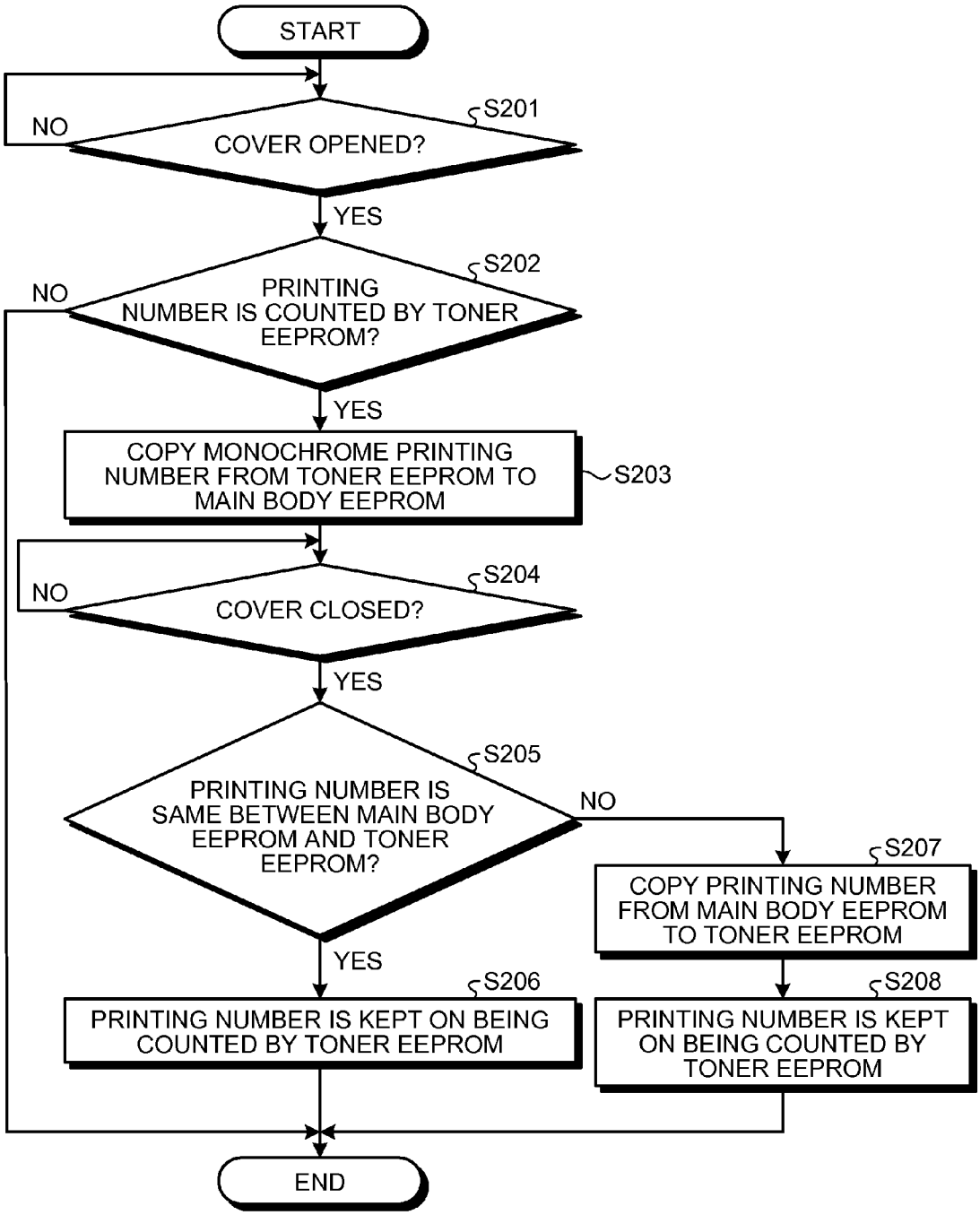
FIG. 3 is a flowchart showing a procedure of a copy-number recording process at the time of opening/closing of a cover of the image forming apparatus according to the embodiment.

FIG. 3 is a flow chart showing a procedure of recording the printing quantity when the cover of the MFP is opened or closed.

When the cover of the MFP main body is opened, the toner bottle is likely to be replaced. Therefore, if it is detected that the cover is opened, the information including the number of printing sheets is copied from the toner EEPROM 2 to the main body EEPROM 1 mounted on the control board 10 of the MFP main body. Specifically, it is determined first whether the cover is opened (step S201). If YES at the step S201, the process flow depends on whether the status is already detected as the toner near end. If the status is already detected as the toner near end, the number of printing sheets is already counted by the main body EEPROM 1 mounted on the control board 10 of the MFP main body. Thus, it is determined whether the number of printing sheets is counted by the main body EEPROM 1 or the toner EEPROM 2 (step S202).

If it is determined that the number of printing sheets is counted by the toner EEPROM 2 at the step S202 (YES at step S202), the number of printing sheets is immediately copied from the toner EEPROM 2(K) to the main body EEPROM 1, since the toner bottle is likely to be replaced when the cover is opened (step S203). Then, it is determined whether the cover is closed (step S204). If the cover is closed, the toner bottle was likely to be replaced. Thus, the number of printing sheets is compared between the main body EEPROM 1 mounted on the control board 10 of the MFP main body and the toner EEPROM 2(K) (step S205).

If the number of printing sheets is the same between the main body EEPROM 1 and the toner EEPROM 2(K) (YES at the step S205), it is assumed that the toner bottle was not replaced. Therefore, the number of printing sheets is kept on being counted by the toner EEPROM 2(K) during the printing operation (step S206). On the other hand, if the number of printing sheets is not the same between the main body EEPROM 1 and the toner EEPROM 2(K) (NO at the step S205), it is estimated that the toner bottle was replaced. Therefore, the number of printing sheets is copied from the main body EEPROM 1 to the toner EEPROM 2(K) (step S207). Then, the number of printing sheets is kept on being counted by the toner EEPROM 2(K) (step S208).

Figure 4:
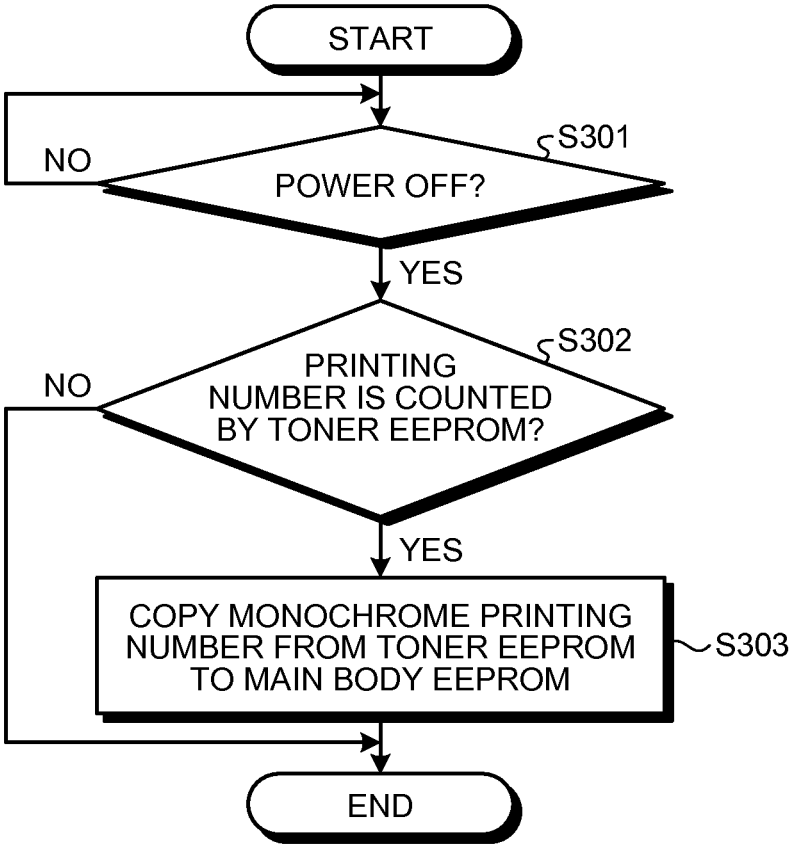
FIG. 4 is a flowchart showing a procedure of a copy-number recording process at the time of power-off of the image forming apparatus according to the embodiment.

FIG. 4 is a flow chart showing a procedure of recording the printing quantity when the power is turned off.

When the power is turned off, the toner bottle is likely to be replaced, as in the case that the cover is opened. Thus, when the power monitor IC 16 detects that the power is turned off (detects the power OFF signal), the information including the number of printing sheets is copied from the toner EEPROM 2(K) to the main body EEPROM 1. Specifically, firstly, the power OFF signal is monitored by the power monitor IC 16 mounted on the control board 10 of the MFP main body (step S301). When the power OFF signal is detected, the number of printing sheets is already counted by the main body EEPROM 1 in the case that the status is already detected as the toner near end. Thus, it is determined whether the number of printing sheets is counted by the main body EEPROM 1 or the toner EEPROM 2(K) (step S302). If the number of printing sheets is counted by the toner EEPROM 2(K), the number of printing sheets is copied from the toner EEPROM 2(K) to the main body EEPROM 1 before the power is turned off (step S303).

Figure 5:
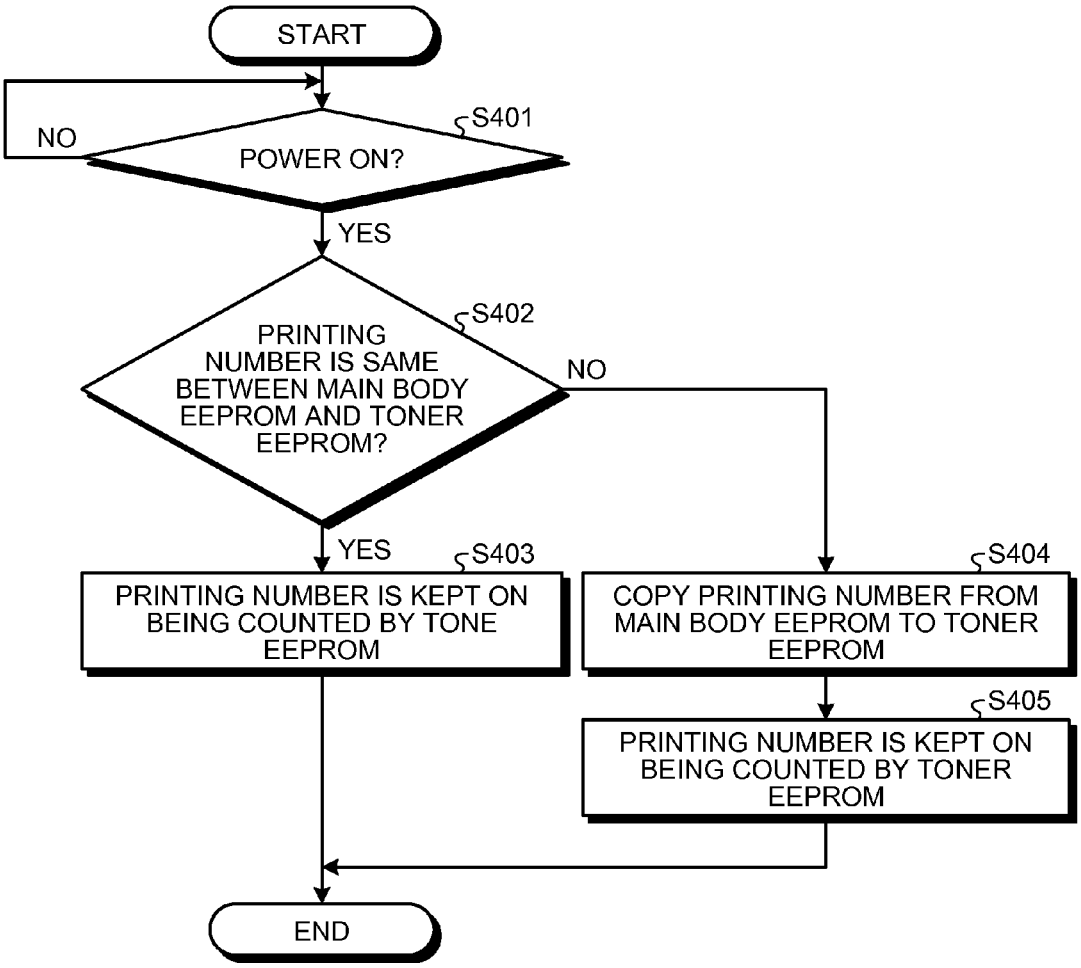
FIG. 5 is a flowchart showing a procedure of a copy-number recording process at the time of power-on of the image forming apparatus according to the embodiment.

FIG. 5 is a flow chart showing a procedure of recording the printing quantity when the power is tuned on.

While the power is turned off, the toner bottle was likely to be replaced. Therefore, when the power is turned on, it is determined whether the number of printing sheets is the same between the main body EEPROM 1 and the toner EEPROM 2(K). Depending on the result, it is determined whether the information is to be copied from the main body EEPROM 1 to the toner EEPROM 2. Specifically, firstly, it is determined whether the power is turned on (step S401). When it is determined that the power is turned on (YES at the step S401), the number of printing sheets is compared between the main body EEPROM 1 and the toner EEPROM 2(K), since the toner bottle was likely to be replaced while the power is turned off (step S402). If YES at the step S402, the number of printing sheets is kept on being counted by the toner EEPROM 2(K), since it is assumed that the toner bottle was not replaced while the power is turned off (step S403).

On the other hand, if NO at the step S402, the number of printing sheets is copied from the main body EEPROM 1 to the toner EEPROM 2(K), since it is assumed that the toner bottle was replaced while the power is turned off (step S404). After that, the number of printing sheets is kept on being counted by the toner EEPROM 2(K) (step S405).

The aforementioned flow charts illustrated by FIGS. 2 *to* 5 shows an example of recording the number of monochrome printing sheets as the counter information to the EEPROM 2 attached to the monochrome toner bottle (K toner bottle). However, the information to be recorded to the toner EEPROM may be the information of the toner remaining amount, the paper consumption amount or the like which requires the rewriting much frequently. Furthermore, instead of or in addition to the toner EEPROM 2, it is possible to use a free space of an EEPROM for controlling the process, such as an EEPROM attached to the photosensitive element cartridge.

Figure 6:
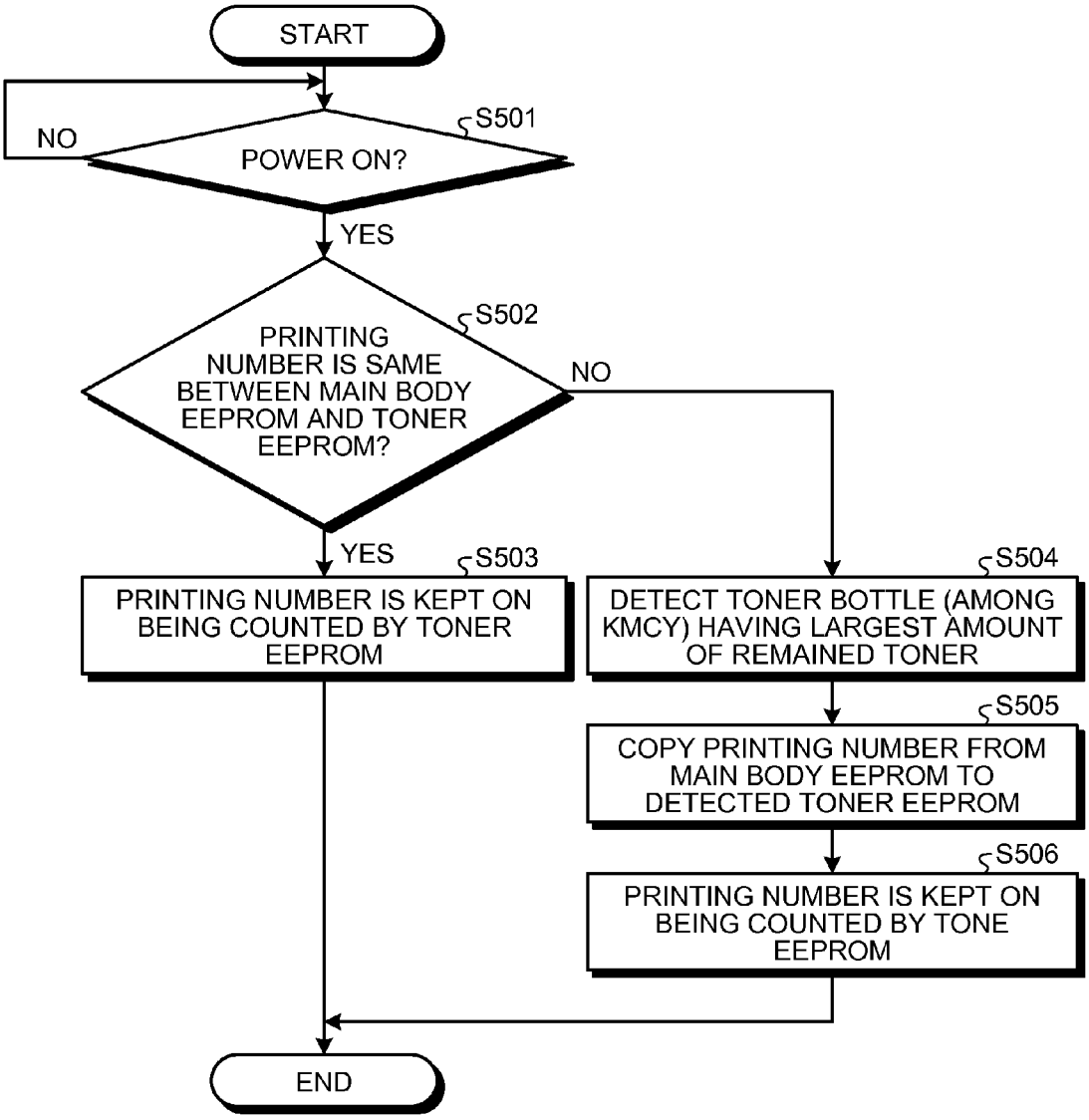
FIG. 6 is a flowchart showing a procedure of a copy-number recording process at the time of power-on of a full-color image forming apparatus according to the embodiment.

FIG. 6 is a flow chart showing a procedure of recording the number of printing sheets when the power is turned on in the color MFP 200 that forms a full color image.

Especially in the color MFP 200, since four toner bottles K, M, C, and Y are mounted, a toner bottle having the largest amount of toner remained therein is detected for determining a toner EEPROM 2, 3, 4, or 5 to which the number of printing sheets is to be recorded. The number of printing sheets is recorded to the toner EEPROM attached to the toner bottle having the largest amount of toner remained therein. This configuration elongates the time until the toner bottle is replaced. Thereby, the frequency of rewriting (the number of times) to the main body EEPROM 1 can be reduced, and thereby the lifetime of the main body EEPROM 1 can be elongated.

Specifically, firstly, it is determined whether the power is turned on (step S501). When it is determined that the power is turned on (YES at the step S501), the number of printing sheets is compared between the main body EEPROM 1 and the toner EEPROM 2, since the toner bottle was likely to be replaced while the power is turned off (step S502). If YES at the step S502, the number of printing sheets is kept on being counted by the toner EEPROM 2, since it is estimated that the toner bottle was not replaced while the power is turned off (step S503). From the step S501 to the step S503 is the same as from the step S401 to the step S403.

If NO at the step S502, it is detected which toner bottle has the largest amount of toner remained therein (step S504). This is because the time until the toner bottle is replaced can be elongated and thereby the frequency of rewriting to the main body EEPROM 1 can be reduced, by recording the information to the toner EEPROM attached to the toner bottle having the largest amount of toner remained therein. Then, the number of printing sheets is copied from the main body EEPROM 1 to the toner EEPROM attached to the toner bottle which is detected or determined as the bottle having the largest amount of toner remained therein (step S505). After that, the number of printing sheets is kept on being counted by the toner EEPROM attached to the toner bottle thus determined (step S506).

In the present embodiment, EEPROM 2(K), 3(M), 4(C) or 5(Y) records the number of printing sheet(s) which is/are printed by using toner contained in each toner bottle KMCY. Instead of the number of printing sheets, it is possible to record the control or management information such as ID information of each toner bottle. In this case, the LSB side information (LSB data) of the counter information representing the control information of the MFP main body is recorded into a space other than a space to which the control information of each EEPROM 2(K), 3(M), 4(C), and 5(Y) is recorded.

Specifically, MSB data (e.g. 4 bits out of 8 bits) from among the counter information such as the number of monochrome printing sheets or the number of color printing sheets, which requires the rewriting less frequently, is controlled by the main body EEPROM 1 mounted on the control board 10 of the MFP main body. On the other hand, LSB data (e.g. 4 bits out of 8 bits) from among the counter information such as the number of monochrome printing sheets or the number of color printing sheets, which requires the rewriting much frequently, is controlled by the toner EEPROM 2 (or cartridge EEPROM) mounted on the toner bottle (or the cartridge). Thus, when it is detected that the replacement of the toner bottle is coming shortly, the counter information is copied from the toner EEPROM 2 (or the cartridge EEPROM) to the main body EEPROM 1. After the toner bottle is replaced with a new one, the counter information recorded in the main body EEPROM 1 is returned to the toner EEPROM 2 (or the cartridge EEPROM). Thereby, the EEPROM attached to the toner bottle or the cartridge is replaced as a consumable component, while the rewriting to the main body EEPROM 1 is saved in its number of times. Thus, the lifetime of the main body EEPROM 1 can be elongated.

As described above, according to the embodiment, the following advantages can be obtained.

First, the number of monochrome printing sheets or the number of color printing sheets is controlled or managed by the toner EEPROM 2, which is conventionally controlled or managed by the main body EEPROM 1 mounted on the control board 10 of the MFP main body. Due to this configuration, since the printing capacity of the toner bottle is approximately a ten thousand sheets, each toner EEPROM is refreshed or replaced with a new one every ten thousand sheets in accordance with the replacement of the toner bottle. Therefore, the life time of the EEPROM, which is approximately a hundred thousand rewriting times, is not a serious concern anymore.

Second, when the cover for the replacement of the toner bottle is opened, the number of printing sheets is immediately copied from the toner EEPROM 2 to the main body EEPROM 1, since a toner bottle is likely to be replaced. When the power is turned off, a toner bottle is likely to be replaced as well. Thereby, when the power monitor IC 16 detects the power OFF signal, the number of printing sheets is immediately copied from the toner EEPROM 2 to the main body EEPROM 1. Due to this processing, it is possible to prevent the counter information, such as the number of monochrome printing sheets or the number of color printing sheets, from being lost, even in the case that a toner bottle is unexpectedly replaced.

Third, the LSB side information from among the counter information such as the number of monochrome printing sheets or the number of color printing sheets is distributed to and controlled by the toner EEPROM attached to the toner bottle or the cartridge. Thereby, the frequency of rewriting to the main body EEPROM 1 can be reduced, and thereby the lifetime of the main body EEPROM can be elongated. Namely, the data is distributed based on the LSB and the MSB. Thereby, the data which requires the rewriting much frequently can be efficiently distributed to the EEPROM attached to the consumable component. As a result, the lifetime of the main body EEPROM can be elongated.

According to the present invention, a non-volatile rewritable storage unit mounted on the control board of the image forming apparatus body can be advantageously elongated.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a first storage unit that is a non-volatile and rewritable storage unit mounted on the control unit;

a toner containing unit that contains toner to be used for an image forming operation, the toner containing unit including a second storage unit that is a non-volatile and rewritable storage unit mounted on the toner containing unit;

a detecting unit that detects an amount of the toner remaining in the toner containing unit;

a control unit configured to, count a number of times an image forming operation is performed by the image forming apparatus, store the number of times the image forming operation is performed as count information in the second storage unit mounted on the toner containing unit, the count information being persistent across replacements of the toner containing unit, and copy the count information from the second storage unit to the first storage unit, when the detecting unit detects that the amount of the toner remaining in the toner containing unit is below a threshold, wherein, the count information remains stored in the first storage unit, until the toner containing unit is replaced with a new toner containing unit.

2. The image forming apparatus according to claim 1, wherein

MSB (Most Significant Bit) information from among the count information is stored into the first storage unit, and LSB (Least Significant Bit) information from among the count information is stored into the second storage unit, when the count information is stored into the second storage unit.

3. The image forming apparatus according to claim 1, further comprising:

a cover detecting unit that detects whether a cover is opened or closed, wherein the control unit copies the count information from the second storage unit to the first storage unit when the cover detecting unit detects that the cover is opened, the control unit determines whether the count information stored in the first storage unit is the same as the count information stored in the second storage unit when the cover detecting unit detects that the cover is closed, and the control unit copies the count information stored in the first storage unit to the second storage unit when the control unit determines that the count information stored in the first storage unit is not the same as the count information stored in the second storage unit.

4. The image forming apparatus according to claim 1, further comprising:

a power detecting unit that detects whether a power is turned on or off, wherein the control unit copies the count information from the second storage unit to the first storage unit when the power detecting unit detects that the power is turned off, the control unit determines whether the count information stored in the first storage unit is the same as the count information stored in the second storage unit when the power detecting unit detects that the power is turned on, and the control unit copies the count information stored in the first storage unit to the second storage unit when the control unit determines that the count information stored in the first unit is not the same as the count information stored in the second storage unit.

5. The image forming apparatus according to claim 4, wherein the control unit determines whether the count information stored in the first storage unit is the same as the count information stored in the second storage unit when the power detecting unit detects that the power is turned on, and the control unit copies the count information stored in the first storage unit to the second storage unit mounted on the toner containing unit having the largest amount of the toner remained therein when the control unit determines that the count information stored in the first unit is not the same as the count information stored in the second storage unit.

6. The image forming apparatus according to claim 1, wherein the count information is information about a printing quantity or information for controlling a process implemented by the image forming apparatus.

7. The image forming apparatus according to claim 1, wherein the second storage unit is mounted on a process cartridge including a photosensitive element in addition to or instead of the toner containing unit.

8. The image forming apparatus according to claim 1, wherein the controller is configured to copy the count information from the second storage unit to the first storage unit during a copying event, the copying event being one or more of an opening of a cover of the image forming apparatus and a change in a state power supplied to the image forming apparatus.

9. A method of controlling a storage unit for an image forming apparatus including a control unit that controls each component, a first storage unit that is a non-volatile and rewritable storage unit mounted on the control unit, a toner containing unit that contains toner to be used for an image forming operation, the toner containing unit including a second storage unit that is a non-volatile and rewritable storage unit mounted on the toner containing unit, and a detecting unit that detects an amount of the toner remained in the toner containing unit, the method comprising:

counting a number of times an image forming operation is performed by the image forming apparatus;

storing the number of times the image forming operation is performed as count information in the second storage unit mounted on the toner containing unit, the count information being persistent across replacements of the toner containing unit; and copying the count information from the second storage unit to the first storage unit, when the detecting unit detects that the amount of the toner remaining in the toner containing unit is below a threshold, wherein the count information remains stored in the first storage unit, until the toner containing unit is replaced with a new toner containing unit.

10. The method of claim 9, wherein the copying the count information from the second storage unit to the first storage unit is performed when a copying event occurs, the copying event being one or more of an opening of a cover of the image forming apparatus and a change in a state power supplied to the image forming apparatus.

11. A computer program product comprising a non-transitory computer-readable medium having computer-readable program codes embedded therein for controlling a storage unit by a computer for an image forming apparatus including a control unit that controls each component, a first storage unit that is a non-volatile and rewritable storage unit mounted on the control unit, a toner containing unit that contains toner to be used for an image forming, the toner containing unit including a second storage unit that is a non-volatile and rewritable storage unit mounted on the toner containing unit, and a detecting unit that detects an amount of the toner remained in the toner containing unit, the program codes when executed causing the computer to execute:

counting a number of times an image forming operation is performed by the image forming apparatus, storing the number of times the image forming operation is performed as count information in the second storage unit mounted on the toner containing unit, the count information being persistent across replacements of the toner containing unit, and copying the count information from the second storage unit to the first storage unit, when the detecting unit detects that the amount of the toner remaining in the toner containing unit is below a threshold, wherein the count information remains stored in the first storage unit, until the toner containing unit is replaced with a new toner containing unit.

* * * * *